United States Patent [19]

Plas

[11] 4,216,413

[45] Aug. 5, 1980

[54] SYSTEM FOR SEQUENTIALLY OPERATING FLASH LAMPS IN REPEATED SEQUENCES

[75] Inventor: Jean J. Plas, Wezembeek-Oppem, Belgium

[73] Assignee: Societe Anonyme des Etablissements Adrien De Backer, Brussels, Belgium

[21] Appl. No.: 26,349

[22] Filed: Apr. 2, 1979

[30] Foreign Application Priority Data

Mar. 13, 1979 [BE] Belgium ..... 193984

[51] Int. Cl.[2] ..... H05B 41/34; G08G 5/00

[52] U.S. Cl. ..... 315/323; 315/200 A; 315/241 R; 340/26; 340/310 R; 340/331

[58] Field of Search ..... 315/200 A, 208, 209 R, 315/241 R, 323, 324; 340/25, 26, 82, 310 R, 310 A, 331

[56] References Cited

U.S. PATENT DOCUMENTS 3,488,558 1/1970 Grafton ..... 315/323 X 3,531,765 9/1970 Christianson et al. ..... 340/26

3,873,962 3/1975 Eggers et al. ..... 340/331 X

*Primary Examiner*—Eugene R. LaRoche

*Attorney, Agent, or Firm*—Young & Thompson

[57] ABSTRACT

A control system which is organized such that a power distribution line only is required for connecting the control unit and the flash lamps and such that the sequencing control, the energy level control of the light bursts and the positive monitoring of the lamp operation are centralized in the control unit. The usual high voltage storage capacitors and the related charge and protection circuitries are consequently needless in the triggering circuit associated with each flash lamp. The lamps are triggered by a burst of pulsed voltage waveforms which are applied on the power distribution line in synchronism with positive half cycles of the supply voltage at the control unit, each pulsed waveform being associated to the control of a respective flash lamp.

3 Claims, 3 Drawing Figures

1
1
1
P
P
P
100
6
5
R
4
M
50
110
110
Vo
210
430
310
20
$V_T$
220
2
200
TC 21
26
27
31
MNSP
40
30
310
380
22
33
24
35
37
N2
38
C
Vo
23
36
N1
A
B
34
41
25
320
430
MNSN
29
32
42
43
28

10
100
15
16
17
13
14
VLSP
18
11
RS
INFR
12
N
44
49
48
51
47
45
46
52
120
9
7
8
P

SYSTEM FOR SEQUENTIALLY OPERATING FLASH LAMPS IN REPEATED SEQUENCES

BACKGROUND OF THE INVENTION

The present invention relates to a system for sequentially operating a plurality of flash lamps in repeated sequences.

Flash lamps are lamps constructed such that, when triggered, they emit a short burst of intense light. Such flash lamps are employed as guiding flashers on airports for the visual aid to the aircrafts approaching the landing runways. These flash lamps are installed on or near the ground so as to indicate the route to the final runway. Such flash lamps are installed in groups and the lamps in each group are placed and oriented so as to be easily seen from the preceeding group of flash lamps and so that an aircraft in landing approach mode is able to follow them with at least the minimum approach requirements. The flash lamps can be curvilinear rectilinear or a combination of both, depending on the needs.

So far, the operation of the guiding flash lamps is controlled by a system organized for transmitting control pulses to the different lamps on one or several control lines, specially intended for that purpose, which are distinct from the power distribution line feeding the lamps. Each lamp is triggered through an individual panel containing a trigger circuit which is responsive to the control pulses and a set of high voltage power storage capacitors connected across the power distribution line. The positive monitoring of the good operation of the flash lamps requires a special transmission line to be installed. The control of the power level of the light burst produced by the flash lamps is made from the control tower by way of another transmission line. Such a control system is complicate and expensive to install due to the fact that it requires the installation of several transmission lines extending between the control tower, a control unit and the flash lamps and to the fact that it requires high voltage storage capacitors for being charged progressively from the line voltage between succeeding bursts of a same lamp and for being discharged instantaneously through the lamp in order to produce a very short yet intense light burst.

SUMMARY OF THE INVENTION

It is an object of the invention to provide an improved control system for the sequential operation of flash lamps in repeated sequences, which is simple and substantially less expensive.

This object is attained in accordance with this invention by a system comprising a control unit and trigger circuits organized in such manner that a power distribution line only is required for connecting the control unit and the flash lamps and such that the sequencing control, the energy level control of the light bursts and the positive monitoring of the lamp operations are centralized at the control unit. The usual command and signalling lines as well as the high voltage storage capacitors together with the usual related charge and protection circuitries are consequently canceled.

DESCRIPTION OF AN EMBODIMENT

Figure 1:
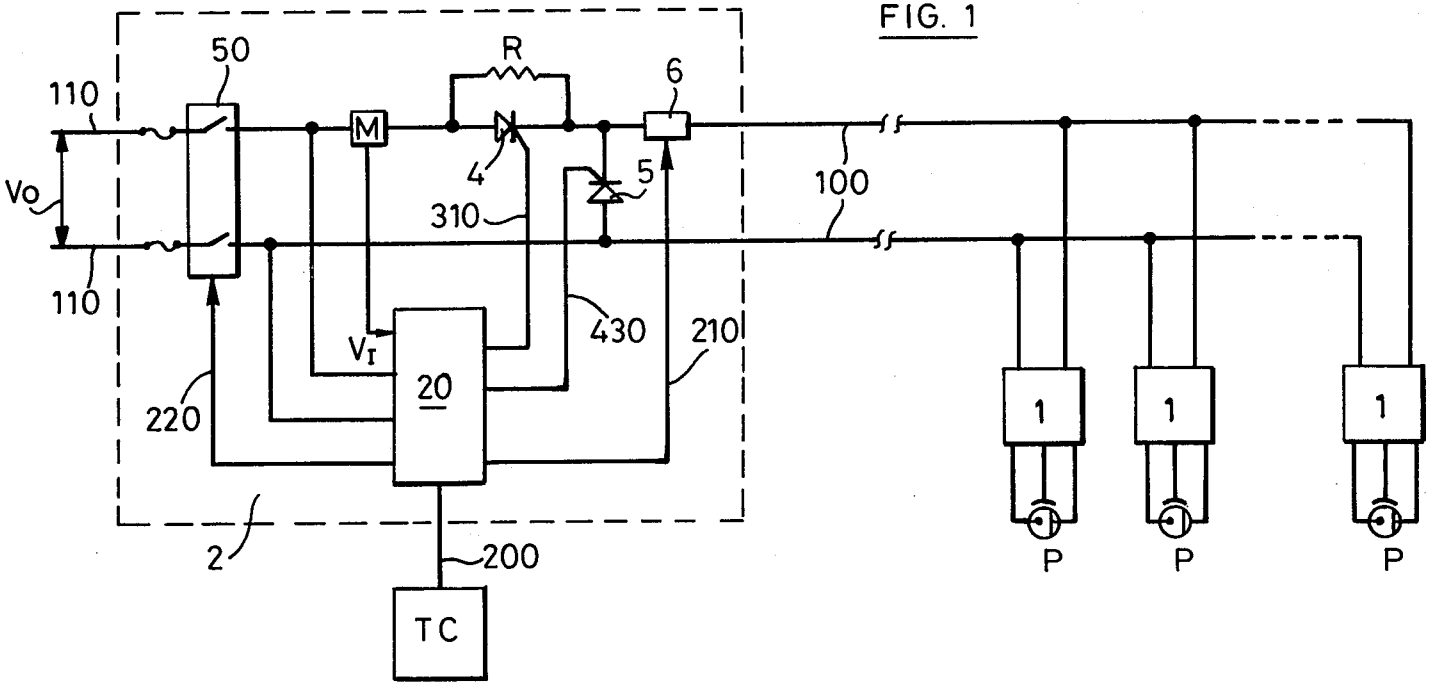
FIG. 1 is a block diagram of the control system in accordance with the invention.

Referring to FIG. 1, several flash lamps P are connected across the power distribution line 100 through individual boxes 1 each containing the trigger circuit for the associated flash lamp. The distribution line 100 connects the boxes 1 to a control unit 2 which in turn has its input terminals connected across as AC supply voltage source Vo by way of line 110. The control unit 2 is also connected to the control tower TC by way of line 200. The purpose of the control system in accordance with the invention is to control the operation sequencing of the flash lamps P in a reliable manner by using the distribution line only. For that purpose, the invention provides a special organization for the control unit 2 and the individual trigger circuits in the boxes 1.

The control unit 2 is organized for controlling the sequencing of operations of the flash lamps P in synchronism with defined positive half cycles of the supply voltage Vo. The unit 2 comprises an SCR 4 connected in series with the distribution line 100 so that, whenever it is fired, it conducts one positive half cycle of the supply voltage Vo. A second SCR 5 is connected across the line 100 with its cathode electrode connected to the cathode electrode of SCR 4. Whenever SCR 5 is fired, it conducts a current which is limited by resistor R, thereby to permit the line 100 to be shorted while preventing shortage of the source Vo. Upstream of SCR 4 there is connected a sub-assembly in logic unit 20 with the purpose of producing two bursts of pulses MNSP and MNSN for the firing control of the SCR's 4 and 5 in close synchronism with defined half cycles of voltage Vo as will be seen later herein.

Figure 2:
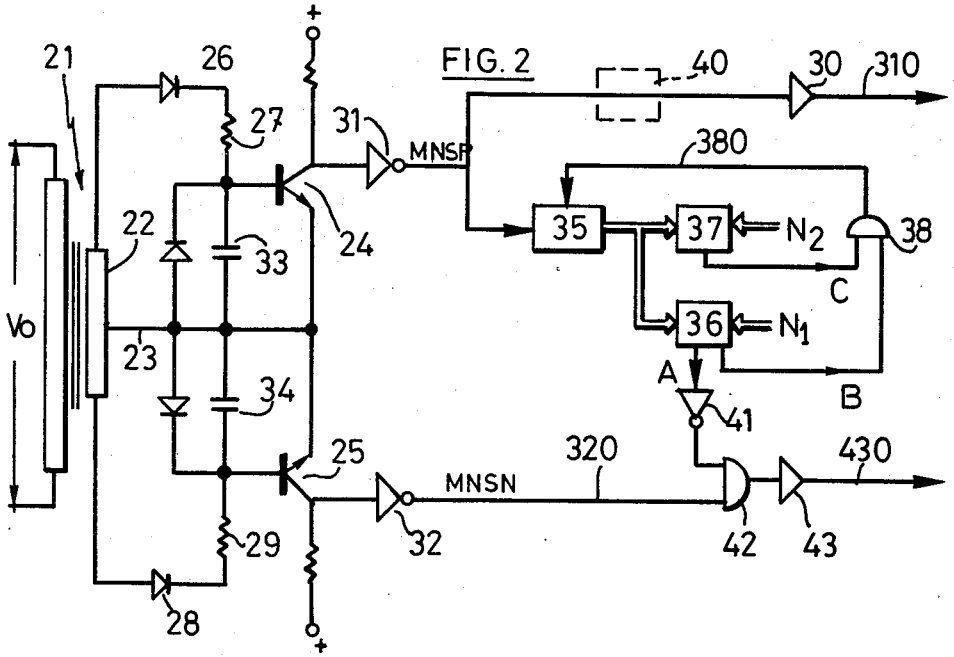
FIG. 2 is a schematic diagram of an exemplary embodiment for the logic sub-assembly in the control unit according to the invention.

FIG. 2 is a schematic drawing of the sub-assembly in logic unit 20 which is specially organized in accordance with this invention. The other sub-assemblies which are devoted to performing usual and well known tasks beyond the scope of this invention, are not represented. The transformer 21 has its primary winding connected across the voltage Vo and its central tapped secondary winding 22 has its terminals connected to the base electrodes of transistors 24 and 25 through series connected diode-resistor circuits viz. the elements 26 and 27 for transistor 24 and the elements 28 and 29 for transistor 25. The bases of said transistors are thereby biased in phase opposition. The collector of each of said transistors is connected to an inverter, 31, 32 respectively. At the output of inverter 31 there appears a burst of pulses MNSP which correspond to the positive half cycles of voltage Vo and at the output of inverter 32 there appears a burst of pulses MNSN which correspond to the negative half cycles of voltage Vo. The capacitors 33, 34 form with resistors 27, 29 two time-constant circuits which provide to the pulses MNSP and MNSN a small phase delay, e.g. 15° and 105° respectively, relative to voltage Vo. This phase delay will have further consideration later herein.

The burst of pulses MNSP is applied by line 310 to the gate electrode of SCR 4 through an amplifier element 30. In the simple system described so far, the SCR 4 is fired during each pulse MNSP in synchronism with the positive half cycles of voltage Vo. In a more sophisticated system wherein it is required that some of the flash lamps installed be kept unoperated, the pulses MNSP are processed in the logic unit 20 in order to detect amongst all the positive half cycles of voltage Vo, those during which the light bursts should be produced. Said processing function is symbolically represented in FIG. 2 by the block in dotted line, designated by numeral 40 and which would consist of a processing sub-assembly within the ability of those skilled in the art.

As a result of the mechanism just described there appears on the distribution line 100 sequences of pulsed voltage waveforms which contain the operation commands for the flash lamps P. It is the duty of the individual trigger circuit in the box 1 associated with each flash lamp to interpret said pulsed voltage waveforms as will be seen later, in order to derive therefrom the proper trigger control signal for the flash lamp.

The pulses MNSP also operate a binary counter 35 having two comparators 36, 37 associated therewith. Each comparator accepts the content of the counter 35 for having it compared with a respective threshold. The comparator 36 is set with a threshold N1 representing the number of flah lamps which must be operated in sequence. The comparator 37 is set with a threshold N2 representing the ratio of the time interval between the beginning of two succeeding sequences to the period of the supply voltage Vo (N2 is always greater than N1).

The comparators 36 and 37 are connected for producing three signals: signal A when the content of counter 35 is lower than N1, signal B when the content of counter 35 is higher than N1 and signal C when the content of counter 35 is equal to N2. The signal A indicates that an operation sequence is proceeding, the signal B indicates the occurrence of a pause between two operation sequences, and the signal C indicates that the first flash lamp has to be fired again in the next sequence. The signals B and C are AND'ed in gate 38 in order to reset the counter 35 through line 380.

The circuit comprising the components 41–43 serves as an out-of-sequence monitor in phase with the negative half cycles of voltage Vo. The inverter 41 accepts the signal A and applies the inverse thereof $\overline{A}$ to an input to AND-gate 42. The second input to gate 42 accepts the pulses MNSN appearing on line 320 from inverter 32. The output signal from gate 42, after amplification in amplifier 43, is applied to the gate electrode of SCR 5. In this way, the SCR 5 is fired during the pauses between succeeding sequences and it thereby short the distribution line 100 during the negative half cycles. As will be apparent later herein from the description of FIG. 3, the short-circuit of line 100 results in the individual trigger circuits being reset.

The rectangle designated by numeral 6 in FIG. 1 represents impedance means connected in series for the purpose of limiting the current intensity on the distribution line 100. This impedance means 6 is arranged to be adjustable in response to a signal applied on line 210 from the logic unit 20 under the control of a level command received from the control tower on line 200.

In FIG. 1 the device 50 is a circuit-breaker controlled from the control tower TC by way of line 220 and the elements designated by the reference F are usual protection fuses.

The organization of the control unit in accordance with the invention permits by simply varying the thresholds N1 and N2 set at the comparators 36 and 37, to adapt the system to the operating conditions:

(a) number of flash lamps to be operated during one operation sequence,
(b) time interval between two successive bursts of light during one operating sequence, by integer multiples of the supply voltage period,
(c) length of pause between two succeeding operating sequences, by integer multiples of the supply voltage period.

The organization of the control unit according to this invention also permits the monitoring of the system operation as a whole to be centralized on the basis of the following informations, available at the control unit itself: the pulses MNSP and MNSN, the content of counter 35 and a signal $V_I$ representing the amplitude of the current in the distribution line, as measured by means of current measuring means represented by block M in FIG. 1. These informations together form a source of data which is particularly significant as it enables the following functions to be performed:

(a) setting the correspondence between the actual level of the line current and the command transmitted on line 200,
(b) setting the correspondence between the instantaneous line current and the firing command for SCR 4,
(c) geographical localization of defective flash lamps,
(d) detection of the distribution line 100 being shorted,
(e) counting the number of defective lamps and determination as to whether the defective lamps are succeedingly operable lamps or not.

Figure 3:
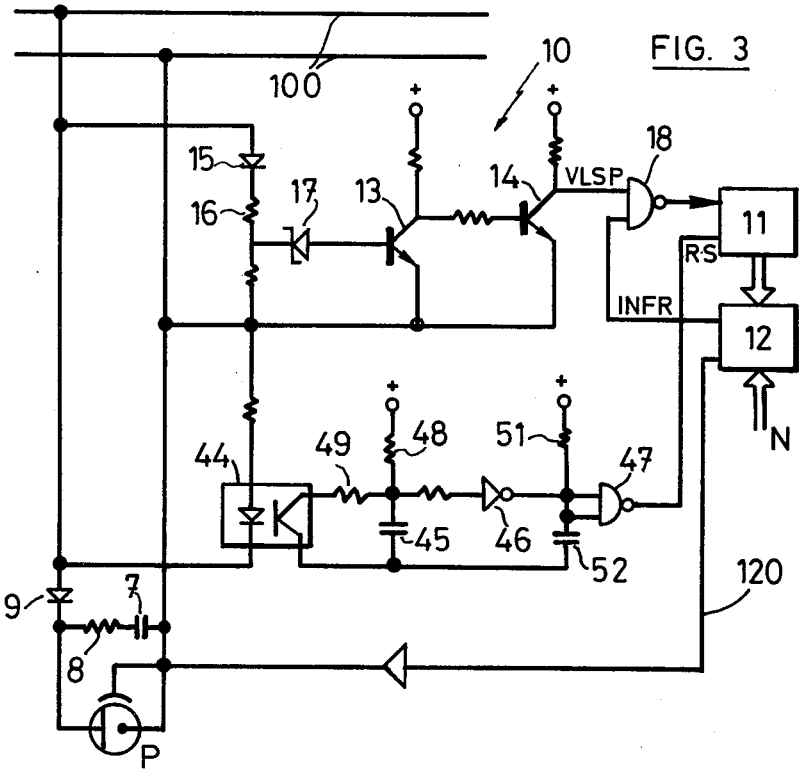
FIG. 3 is a schematic diagram of an individual lamp trigger circuit according to the invention.

Reference in now made to FIG. 3 for describing the organization of the individual lamp trigger circuit contained in each panel 1. As apparent from the foregoing, the operation commands for the lamps are transmitted on the distribution line through repeated bursts of pulsed waveforms and it is the function of each individual lamp trigger circuit to interpret the transmitted pulsed waveforms on the distributed line 100 for deriving therefrom, in an unambiguous and reliable way, the proper trigger signal for the associated flash lamp. Each trigger circuit 1 comprises a trigger logic 10 connected across the distribution line 100 for the purpose of detecting and counting, during each burst or operation sequence, the positive half cycles of the voltage on line 100. The device 11 is a binary counter, the device 12 is a comparator connected for comparing the content of counter 11 with a coded threshold N which represents the geographical location of the associated lamp. The coded threshold N set at each trigger circuit thus is distinct for each circuit and associated lamp. The comparator 12 is arranged to produce a trigger signal on line 120 in response to the content of counter 11 being equal to the threshold N set, that is when the content of counter 11 is the image of the geographical location of the lamp to be operated at that time.

The counter 11 starts from zero at every new operation sequence and it is operated by pulses produced by pulse generator means essentially comprising the transistors 13 and 14 connected in series. When the line voltage V100 is positive, said voltage is applied to the base electrode of transistor 13 through the input circuit 15–17: the transistor 13 reaches its saturation level and thereby causes transistor 14 to be non conducting. In this case, with the line voltage V100 being positive, the collector electrode of transistor 14 (signal VLSP) is high. When the line voltage V100 est negative, the transistor 13 is non conducting and transistor 14 is at its saturation level: the signal VLSP then is low or logical 0.

The circuit components are chosen such that signal VLSP has a rising edge which is delayed by a small phase angle value, e.g. 15°, relative to the voltage V100, thereby to assure an higher reliability and a better triggering efficiency for the flash lamps inasmuch the lamp firing then is less sensitive to the triggering time. In this way, there is no need for individual adjusting or control means to be provided as is usual in prior art devices.

The device 18 in FIG. 3 is an NAND-gate which is connected to accept the signal VLSP at a first input and a signal INFR at a second input, said signal INFR indicating that the content of counter 11 is lower than the threshold N set at comparator 12. In this way, prior to be allowed to operate the counter 11, the signal VLSP is subjected to the condition of being concurrent with the occurrence of counter content being lower than N, whereby any improper triggering of the associated flash lamp P is prevented. When a faulty condition occurs, the associated lamp P stops operating.

Every flash lamp P is triggered by the respective trigger pulse during each operation sequence. Between the occurrences of two succeeding light bursts, a storing capacitor 7 connected in series with resistor 8 across the line voltage V100, gradually charges to the voltage peak value and said capacitor 7 remains charged due to the presence of diode 9. At the time of triggering the flash lamp P, the latter is fired under the maximum voltage, which results in the following advantages:

(a) maximum triggering reliability and great insensitivity to the variations of the triggering phase angle, (b) the storing capacitor associated with the lamp P needs to have a very small value only (typically 0.5 microfarad); the capacitor value has only to be sufficient for maintaining the lamp conduction between the triggering time and the time when the line voltage reaches a value equal to the arcing voltage, (c) possibility to choose a small triggering phase angle and to simultaneously guarantee the constancy of the light burst energy without requirement for an excessive precision and stability of the triggering phase angle.

The counter 11 is reset through detecting the absence of negative half cycles of the voltage V100 on the distribution line 100. It will be reminded that the negative half cycles of the voltage V100 are present on line 100 during each operation sequence, when SCR 5 in the control unit 2 (FIG. 1) is not fired. By contrast, during the pauses between two succeeding sequences, when it is fired, the SCR 5 suppresses the negative half cycles from line 100. The presence or absence of negative half cycles on the distribution line 100 is sensed by optical coupler means 44 which, it is known per se, comprises a luminescent diode coupled with a transistor. The negative half cycles of line voltage V100 drive the transistor in device 44 to saturation, whereby capacitor 45 is kept substantially discharged. The input to the inverter 46 then is at binary 0 level, its output is at binary 1 level and the output of NAND-gate 47 is at binary 0 level. The reset input to counter 11 is consequently disabled.

At the end of an operation sequence, when the negative half cycles of the line voltage are suppressed by SCR5 in the control unit 2, the transistor in device 44 is blocking and capacitor 45 is being charged through resistor 48. The inverter 46 and gate 47 then are switched such that the output from gate 47 is at a binary 1 level which drives the reset input RS of counter 11 high, whereby the counter 11 is reset. As soon as the negative half cycles of the voltage are present again on line 100, the capacitor 45 instantaneously discharges through resistor 49 so that the output from gate 47 is again at binary 0 level and the counter 11 is enabled to start again for a new counting cycle. The resistor 51 and the capacitor 52 serve to force counter 11 to zero during a short time interval after the line voltage is applied to the trigger circuit 1 in order to prevent any arbitrary or hazardous starting of the counter.

What is claimed is:

1. A control system for operating a plurality of flash lamps in repeated sequences, comprising:

a power distribution line to which each of the plurality of flash lamps is connected through an individual trigger circuit, a control unit having input terminals connected across an alternating current power source and output terminals connected to the power distribution line, the control unit comprising:

first controlled switching means connected in series between the input and the output terminals for transmitting a positive half cycle of the power source voltage each time it is gated by a pulse being applied to its control electrode, said pulse corresponding to a triggering command for a respective flash lamp, second controlled switching means connected across the output terminals thereby to short circuit the power distribution line each time it is gated by a pulse being applied to its control electrode, means connected across the power source voltage for detecting the half cycles of the power source voltage and producing a first burst of pulses in which each pulse corresponds to a positive half cycle of the power voltage and a second burst of pulses in which each pulse corresponds to a negative half cycle of the power source voltage, the pulses of said first burst of pulses being applied to the control electrode of the first controlled switching means, counting means connected to accept said first burst of pulses from the detecting means for counting said pulses up to a number equal to the number of flash lamps to be operated in sequence, said counting means being further connected to produce a control signal when the number of said pulses is equal to said number of flash lamps to be operated in sequence, and gating means connected to accept the second burst of pulses from the detecting means and being responsive to the control signal from the counting means for transferring the second burst of pulses to the control electrode of said second controlled switching means, thereby to short the power distribution line and suppress the negative half cycles of the voltage thereon during the time intervals between succeeding operation sequences.

2. The system according to claim 1, wherein each individual trigger circuit comprises first detecting means connected across the power distribution line from the control unit for producing a pulse in response to each occurrence of a positive half cycle of the voltage on the distribution line, counting means connected to accept the pulses from said first detecting means and to count said pulses up to a predetermined number, distinct for each individual trigger circuit, said counting means being arranged to produce a trigger control signal in response to the number of incoming pulses being equal to said predetermined number, second detecting means connected across the power distribution line to produce a reset signal for said counting means in response to the negative half cycles of the voltage on the distribution line being absent.

3. The system according to claim 1, wherein, each individual trigger circuit further comprises, connected across the flash lamp, storing means for the peak value of the voltage on the distribution line, said storing means comprising resistor and capacitor means connected in series, said storing means being further connected across the distribution line through diode means.

* * * * *